US010205214B2

(12) United States Patent
Karhu

(10) Patent No.: US 10,205,214 B2
(45) Date of Patent: Feb. 12, 2019

(54) RADIO-FREQUENCY FILTER

(71) Applicant: Nokia Solutions and Networks Oy, Espoo (FI)

(72) Inventor: Kimmo Kalervo Karhu, Oulu (FI)

(73) Assignee: Nokia Solutions and Networks Oy, Espoo (FI)

( * ) Notice: Subject to any disclaimer, the term of this patent is extended or adjusted under 35 U.S.C. 154(b) by 0 days.

(21) Appl. No.: 15/453,961

(22) Filed: Mar. 9, 2017

(65) Prior Publication Data

US 2017/0263996 A1 Sep. 14, 2017

(30) Foreign Application Priority Data

Mar. 11, 2016 (EP) ..... 16159756

(51) Int. Cl.
*H01P 7/10* (2006.01)
*H01P 1/208* (2006.01)

(52) U.S. Cl.
CPC ..... *H01P 7/105* (2013.01); *H01P 1/2086* (2013.01)

(58) Field of Classification Search
CPC ..... H01P 7/105; H01P 1/2086
USPC ..... 333/185
See application file for complete search history.

(56) References Cited

U.S. PATENT DOCUMENTS 5,200,721 A 4/1993 Mansour
5,780,072 A 7/1998 Kurisu et al.
6,356,171 B2 3/2002 Fiedziuszko et al.
9,190,705 B2 11/2015 Wu et al.
2003/0043000 A1 3/2003 Karhu
2003/0117244 A1* 6/2003 Matsuura ..... H01P 1/2086 333/219
2014/0225685 A1* 8/2014 Chun ..... H01P 1/2053 333/202

FOREIGN PATENT DOCUMENTS

EP 0742603 A1 11/1996
EP 1320144 A2 6/2003
EP 1858109 A1 11/2007
JP 3061361 B2 7/2000
JP 2008/011101 A 1/2008

* cited by examiner

*Primary Examiner* — Robert J Pascal
*Assistant Examiner* — Kimberly E Glenn
(74) *Attorney, Agent, or Firm* — Harrington & Smith

(57) ABSTRACT

A radio-frequency filter with at least one dielectric multi-mode resonator is provided. The resonator includes a metal housing with a top surface, a bottom surface, four sectors between the top and bottom surfaces, and including a resonator cavity therein. The resonator further includes a dielectric body positioned inside the cavity, the dielectric body having a first thickness between the top and bottom surfaces of the cavity, wherein there is a gap between the sectors of the housing and the dielectric body, the dielectric body including a hollow on the surface facing the top surface of the housing and on the surface facing the bottom surface of the housing, the dielectric body thus having a second thickness at the location of the hollows, the second thickness being smaller than the first thickness.

14 Claims, 5 Drawing Sheets

RADIO-FREQUENCY FILTER

CROSS-REFERENCE TO RELATED APPLICATIONS

The present application claims the benefit under 35 U.S.C. § 119, and any other applicable laws, of application number EP16159756, filed in the EPO on Mar. 11, 2016, the disclosure of which is hereby incorporated by reference in its entirety.

TECHNICAL FIELD

The exemplary and non-limiting embodiments of the invention relate generally to radio-frequency filters. Embodiments of the invention relate especially to radio-frequency filters comprising one or more dielectric multi-mode resonators.

BACKGROUND

The following description of background art may include insights, discoveries, understandings or disclosures, or associations together with disclosures not known to the relevant art prior to the present invention but provided by the invention. Some of such contributions of the invention may be specifically pointed out below, whereas other such contributions of the invention will be apparent from their context.

Radio-frequency filters are typically used in the base stations of mobile telecommunication networks, mobile phones and other radio transceivers. Possible radio-frequency filter applications include the adapter circuits and filter circuits of transmitter and receiver amplifiers.

In base station transmitter and receiver side filters, high Q cavity resonators are typically used. Good radio frequency properties such as low insertion loss and good power handling and a small size are especially required of radio-frequency filters. One typical solution is to use dielectric dual or multimode resonators. However, the realisation of such resonators is not an easy task.

At present, compact tranverse magnetic, TM, dual or single mode cavity resonators need ground contact or full metal plating around the ceramics. A joint between ceramic and metal is difficult to create because of different coefficient of linear temperature expansion. Besides, plating is needed on the ceramic for solder joint. When a fully plated ceramic block is used it is often difficult to connect it to other mechanics and get tunable couplings and frequencies.

There exist some orthogonal TM dual mode/multimode resonators without a straight cavity contact. However, they don't support a wide enough frequency band and they cannot be tuned from one side with good enough spurious response.

BRIEF DESCRIPTION

According to an aspect of the present invention, there is provided a radio-frequency filter, comprising at least one dielectric multi-mode resonator, the resonator comprising: a metal housing with a top surface, a bottom surface, four sectors between the top and bottom surfaces, and comprising a resonator cavity therein; a dielectric body positioned inside the cavity, the dielectric body having a first thickness between the top and bottom surfaces of the cavity, wherein there is a gap between the sectors of the housing and the dielectric body; the dielectric body comprising a hollow on the surface facing the top surface of the housing and on the surface facing the bottom surface of the housing, the dielectric body thus having a second thickness at the location of the hollows, the second thickness being smaller than the first thickness.

Some embodiments of the invention are disclosed in the dependent claims.

BRIEF DESCRIPTION OF THE DRAWINGS

In the following the invention will be described in greater detail by means of preferred embodiments with reference to the attached [accompanying] drawings, in which.

DETAILED DESCRIPTION OF SOME EMBODIMENTS

Radio-frequency filters can be designed using many different technologies. For example, air-filled coaxial, dielectric filled coaxial, micro strip, dielectric filled cavity and dielectric loaded cavity are some examples of known filter types. Each filter type has its advantages and disadvantages. Filters based on dielectric loaded cavities have many good properties such as a high Q-value, good power handling and small size.

Examples of typical communications systems where radio frequency filters are utilised in user terminals and base stations are Global System for Communication GSM, Universal Mobile Telecommunications System (UMTS) radio access network (UTRAN or E-UTRAN), Wideband Code Division Multiple Access WCDMA and Long Term Evolution LTE based systems.

A typical filter based on dielectric loaded cavities comprises at least one dielectric resonator, which has a housing which is typically metal or has a metal coating. Inside the housing are a resonator cavity and a dielectric resonator body. In many cases, a practical filter comprises many elements. For example, the filter may comprise a coaxial resonator at the input and output of the filter and one or more dielectric resonators. The signal to be filtered is fed to the input of the filter. The filter is designed such that the signal couples from one resonator to the next, and at the output is the filtered signal.

Figure 1:
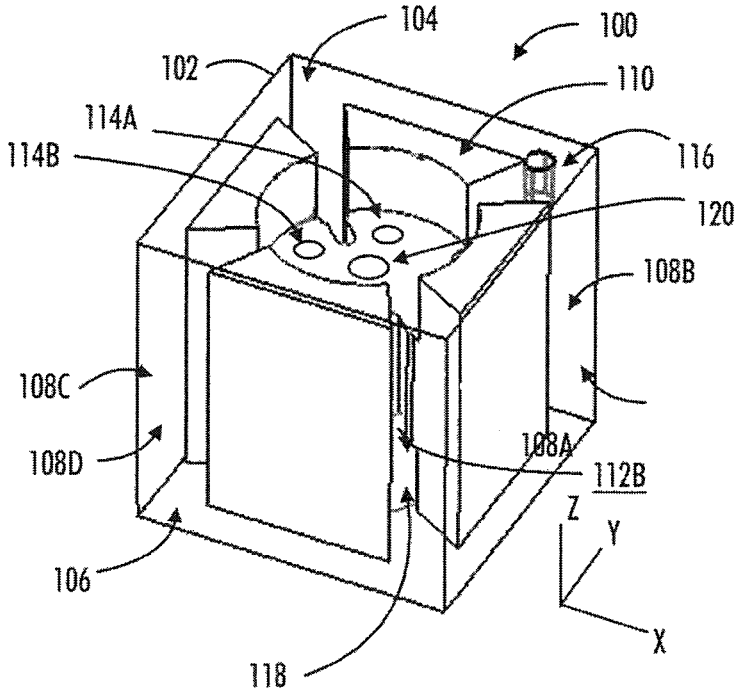
FIG. 1 illustrates an example of a dielectric multi-mode resonator.

Let us first examine a dielectric multi-mode resonator as shown in FIG. 1. The resonator 100 comprises a metal housing 102. The housing has a top surface 104, a bottom surface 106 and four sides 108A, 108N, 108C and 108D. The housing creates a resonator cavity within the top and bottom surfaces and the four sides.

The resonator further comprises a dielectric body 110 positioned inside the cavity. Typically the dielectric body is made of suitable ceramic material. Ceramics used in microwave applications have high relative permittivity $\varepsilon_r$ and very low loss. Typically the materials are temperature stable. Typical materials are: zirconium, tin or titanium oxide (Zr,Sn)TiO barium oxide-lead oxide-neodymium oxide-titanium oxide BaO—PbO—NdO—TiO, and magnesium titanium-oxide-calcium titanium oxide MgTiO—CaTiO, for example. The housing, the resonator cavity and the dielectric body may be a cuboid in shape, such as a cube or rectangular cuboid and define three orthogonal axes x, y and z aligned with the dielectric body as illustrated in FIG. 1, but other shapes are possible as well. The resonator has resonance modes that are substantially aligned with the three orthogonal axes. These modes are typically referred to as TM-modes.

In the example of FIG. 1, the dielectric body 110 has a first thickness between the top and bottom surfaces of the cavity. The dielectric body 110 may further comprise a hollow 112A on the side facing the top surface 104 of the housing and another hollow 112B on the side facing the bottom surface 106 of the housing. Thus, the dielectric body thus has a second thickness at the location of the hollows, the second thickness being smaller than the first thickness. Typically the hollows are of same size, but this is not a necessity. In an embodiment, the second thickness is 20 to 50% smaller than the first thickness but the relationship may also be different.

In an embodiment, the cavity and the dielectric body may have a spherical shape. In such a case, the above-mentioned sides of the dielectric body facing the sides of the housing may be considered to be sectors of the housing and the dielectric body. The three orthogonal axes x, y and z are the defined by the sectors.

In an embodiment, a support structure 118 below the dielectric body 110 connects the dielectric body to the bottom surface 106 of the housing 100. The support structure 118 may be a low $\varepsilon_r$ material like alumina or plastic on the bottom surface 106. The support structure may be glued on ceramic and attached the bottom surface 106 by gluing or using screw fixing, for example.

Figure 2A:
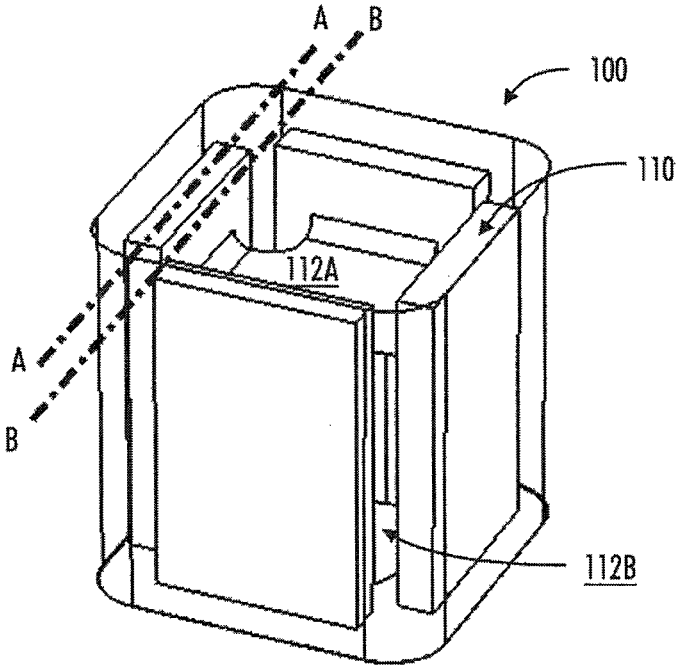
FIGS. 2A to 2C illustrate hollows and first and second thicknesses in dielectric body of a resonator.
Figure 2B:
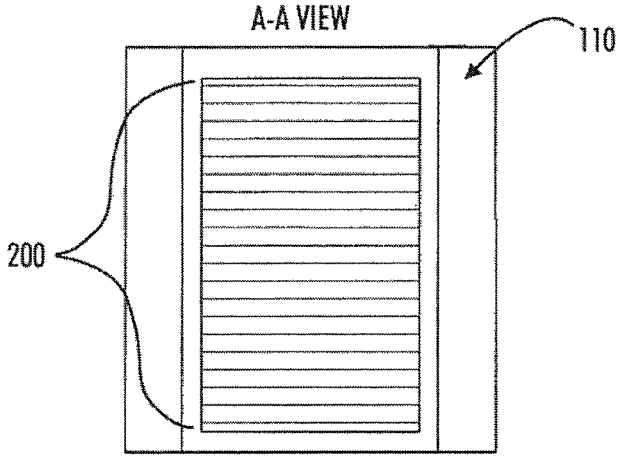
Figure 2C:
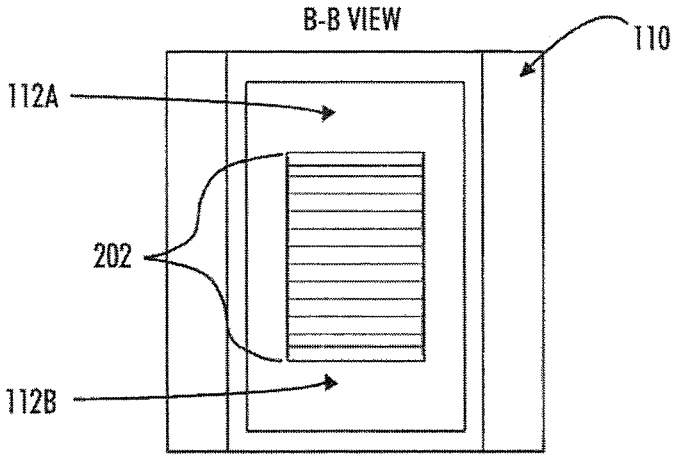

FIGS. 2A to 2C illustrate the hollows and the first and second thicknesses. FIG. 2 illustrates a multi-mode dielectric multi-mode resonator 200 that is in many ways similar to the resonator 100 of FIG. 1. The resonator comprises a metal housing 102 and a dielectric body 110. In the example of FIG. 1 the cross-section of the hollows is circular when viewed from the direction of the top surface 104 of the housing. In the example of FIG. 2A the cross-section of the hollows is square. Further in the example of FIG. 2A, the corners of the metal housing are rounded whereas the in the example of FIG. 1, the corners of the metal housing are sharp. The shape of the corners has no great effect on the operation of the resonator.

FIG. 2B illustrates a view of the resonator at the hatched line A-A. The first thickness 200 of the dielectric body 100 between the top and bottom surfaces of the cavity is more clearly seen.

FIG. 2C illustrates a view of the resonator at the hatched line B-B. The second thickness 202 of the dielectric body 100 between the top and bottom surfaces of the cavity at the location of the hollows is more clearly seen.

Figure 3:
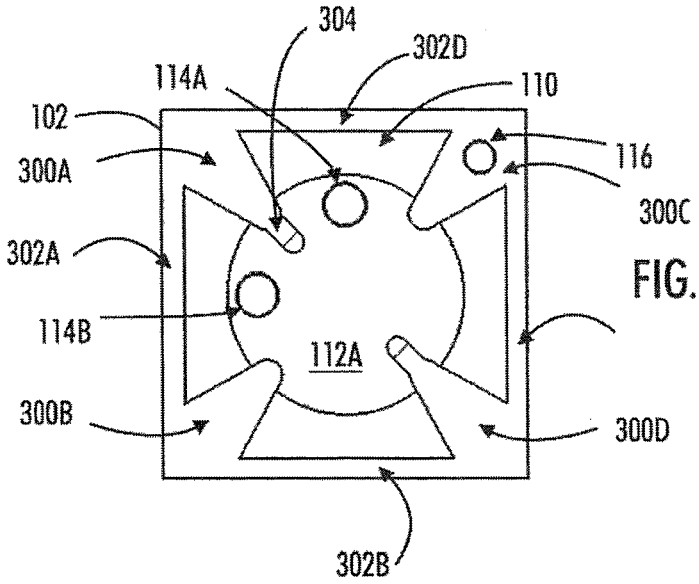
FIG. 3 illustrates a dielectric multi-mode resonator viewed from top side.

FIG. 3 illustrates an embodiment. The example of FIG. 3 illustrates a view of the multi-mode dielectric multi-mode resonator of FIG. 1 seen from the side of the top surface 104. As FIG. 3 illustrates, in this example there are gaps 302A, 302B, 302C, 302D between the sides of the housing and the sides of the dielectric body facing the housing. Thus, the dielectric body does not touch the sides of the metal housing. In an embodiment, the gaps may be of unequal size and have local variations such as dents, for example.

Figure 4:
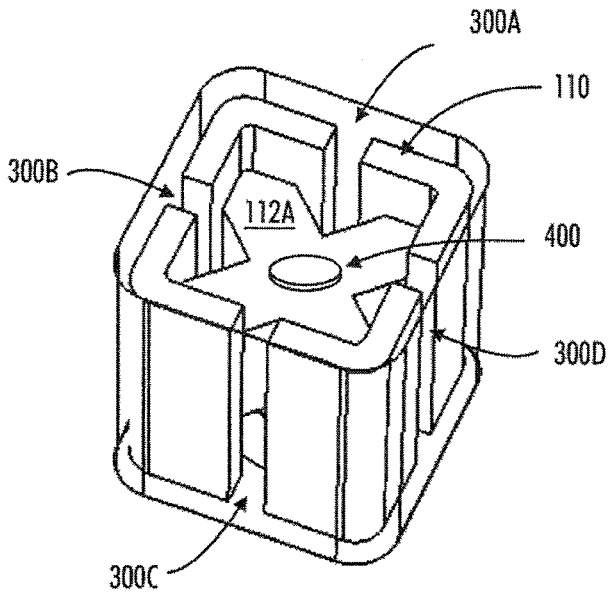
FIG. 4 illustrates another example of a dielectric multi-mode resonator.

In an embodiment, the dielectric body 110 has four cuts 300A, 300B, 300C, 300D dividing the sides of the dielectric body facing the housing into four sections. As illustrated in FIG. 3, the cuts may be unequal size and shape. The cuts may also be of the size and shape. In the examples of FIGS. 1, 2A and 3, the cuts are located at the corners of the dielectric body 110 and also the metal housing. However, the cuts may also be located elsewhere as the example of FIG. 4 illustrates.

If the cuts are asymmetric it causes a coupling between TM modes in the resonator. The coupling increases narrow part 304 of the cut 300A is increased. The coupling can be tuned or produced by the screw 116. If the screw is in the location designated in FIG. 3, it decreases coupling made by the asymmetric grooves. Near a deep groove a screw would decrease coupling. The tuning effect increases when the screw is going deeper inside cavity.

In an embodiment, each of the four sections has a variable width in the direction perpendicular to the top and bottom surfaces of the cavity, wherein the variable width is largest at the side of the section facing the housing.

In an embodiment, the dielectric body 110 has on the side facing the top surface 104 of the housing 102 one or more holes 114A, 114B where one or more screws are inserted. The screws may be used to tune the frequency of the resonator.

In an embodiment, the dielectric multi-mode resonator 100 further comprises one or more vertical screws 116 in the cuts of the resonator body. The screws may be used to tune coupling of the resonator to other resonators in the filter.

With the shape of the dielectric dielectric body described above is possible to manufacture resonator bodies covering a large frequency range, such as bands from 1800 MHz band up to 2600 MHz just by adjusting the height of the resonator bodies in the ceramic part punching process. Only one tool is needed in the manufacturing process. This makes the manufacturing of the resonator bodies easy and cost effective.

In an embodiment, the above described examples of FIGS. 1, 2A-2C, 3 and 4 support TM01 δ(x+y) dual mode resonator or TM01 δ(x+y+z) triple mode or TM01 δ(x+y)+TE01 δ(z) triple mode resonator. The dielectric body 110 has a large surface against the walls or sides of the metal housing (as in FIGS. 1 2A and 3) or edges in rectangle shape cavity (as in FIG. 4) with small air gaps between the dielectric body and the metal housing. In an embodiment, the gaps are <2-10% of the width of the dielectric body 110. A small gap may be difficult to compensate against frequency drift over temperature range and it may be sensitive against dimension tolerances. A large gap may not give advantage to shift TM01 δ(x+y) modes below other modes.

In an embodiment, cuts are not used but the sides of the dielectric body 110 facing the sides 108A, 108B, 108C, 108D of the metal housing are continuous.

After large surface towards centre of dielectric member part there is area which cross section area is much smaller 10-50% comparing to area against side of the metal housing, as illustrated in FIGS. 2B and 2C. When the centre area is thin and narrow the shape shifts TM01 δ(z) and TE01 δ(z) to a higher frequency, typically about 30% higher from TM01 δ(x+y) resonance frequencies. Thus a TM dual mode resonator is supported. When the centre area is thin but wide (y-direction) is possible to get TE01 δ(z) near TM dual mode frequencies, thus a triple mode resonator may be supported. When the centre area is narrow but high the resonator can support TM01 δ(x+y+z) mode.

In an embodiment, as illustrated in FIG. 1, the dielectric body 110 has a hole 120 in the centre of the side facing the top surface 104 of the housing 102. The hole may extend through the resonator body. The hole 120 may be used for screw fixing, or it may be plated whole or partially by silver sintering (as illustrated in FIG. 4 with the plating 400). Thus the resonance frequencies of TM01 δ(x+y) can be shifted 20-50% lower. The plating decreases Q-factor.

For example, if the size of the cavity inside the metal housing 100 is 31(X)×31(Y)×32(Z) mm and commercial 40-45 microwave material with $\varepsilon_r$ between 40 and 45 and FQ around 40000 is used, the frequency of the signal to be filtered being in the 1800 MHz band, a dual mode Q-factor around 2×10000 may be achieved, which means that Q/volume is over 5 times higher compared to a traditional coaxial cavity resonator having the same volume. Thus the proposed structure can miniaturize the size of a filter. The Q-factor is high compared to a TM single or dual mode structure where the resonator end or ends have been plated and have a straight contact to sides of the metal housing.

The maximum electric field (E-field) in the described resonator structure stays relative low ($<4\times10^8$ V/m) with one joule stored energy. The value is low enough to handle peak power demands in typical GSM, WCDMA and LTE band base station filters between 400 MHz to 3500 GHz frequency rage. Because the losses are small in the dielectric part also the high average input power up 150 W can be handled in a filter used the mentioned base station filter bands.

As mentioned, there may be gaps 302A, 302B, 302C, 302D between the sides of the housing and the sides of the dielectric body facing the housing. The gaps compensate possible different coefficient of linear temperature expansion of the metal housing 102 and the dielectric body 110. In addition, the resonator can be compensated against frequency drift over temperature range. Assuming the metal housing is made of aluminium the cavity inside the metal housing typically enlarges more than and the dielectric resonator body. Thus, the dielectric could be selected such that the $\tau\varepsilon_r$ of the dielectric is near 0 ppm/° C. or even positive depending on the temperature expansion coefficient of the dielectric material to compensate dimension changes.

One advantage of the proposed resonator structure is the coupling mechanism to single mode resonators like coaxial TEM mode or single TM01 mode resonator attached on the same bottom surface in a filter design. A special cavity shape and the gap between the sides of the dielectric body and the cavity wall (sides of the housing) enable a good coupling to novel wall element which has also good coupling to single mode resonator. Same wall shape can be utilized to produce cross coupling effects.

Coupling between modes in the dielectric loaded cavity needed in a filter can be created by an asymmetric cavity or asymmetric shape of the dielectric body external conductive members like screws.

An extra advantage is that tuning elements like screws can be placed at the same one surface like lid of the cavity body.

Figure 5:
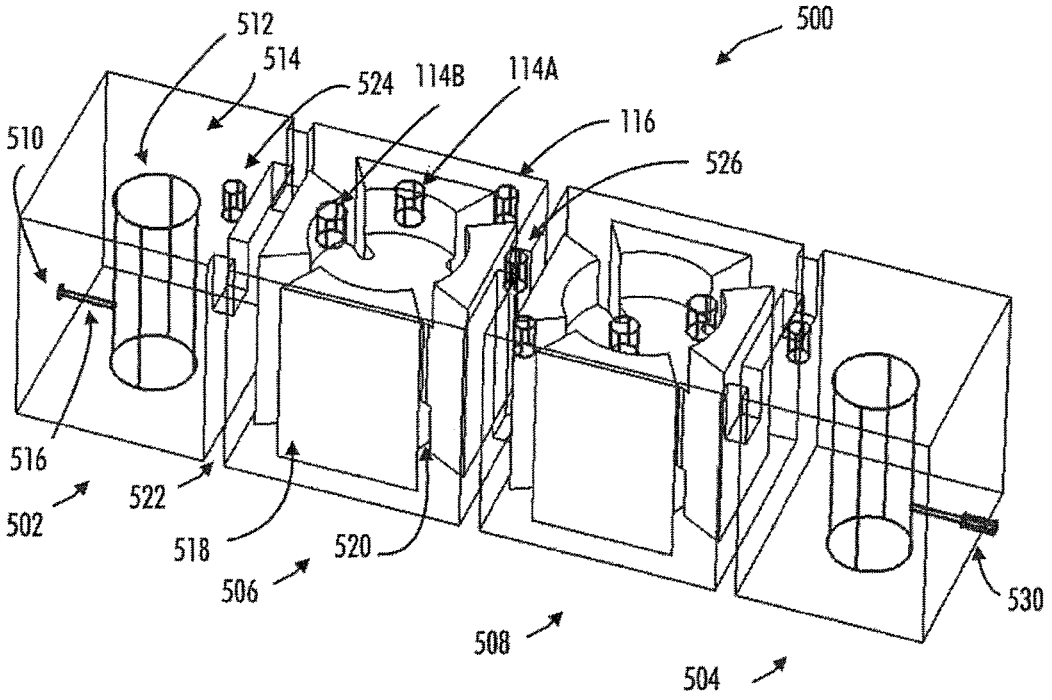
FIG. 5 illustrates an example of a radio-frequency filter.

FIG. 5 illustrates an example of a radio-frequency filter 500 where above described resonator structure is utilised. The example filter of FIG. 5 is an six pole microwave band pass filter consisting of two coaxial resonator cavities 502, 504 and two dual mode dielectric resonators 506, 508.

The first coaxial resonator 502 may be a TEM mode resonator. A coaxial line 510 such as a coaxial cable or connector is connected to the inner rod 512 located in the cavity 514 of the first coaxial resonator 502 via a transmission line 516 such as a metal wire.

The coaxial cavity resonance of the resonator 502 has a coupling to second mode in the dielectric body 518 of the resonator 506. The dielectric body 518 is typically microwave ceramic material with an FQ value around 8000-100000 and a relative permittivity $\varepsilon_r$ between 12 and 80. The dielectric body 518 is supported by a support structure 520, which typically has relatively low relative permittivity ($\varepsilon_r$ around 2 to 10). The support structure is typically alumina or plastic, for example.

The shape and dimensions of the dielectric body 518 and cavity of the resonator 506 may produce two orthogonal TM 01 δ(x−y) modes at the filter pass band. The coaxial resonator 502 has a coupling to TM 01 δ(x) modes that has a high E-field against the wall 522 towards coaxial resonator cavity.

In an embodiment, the above mentioned coaxial resonators are single mode TM01 resonators.

Figure 6:
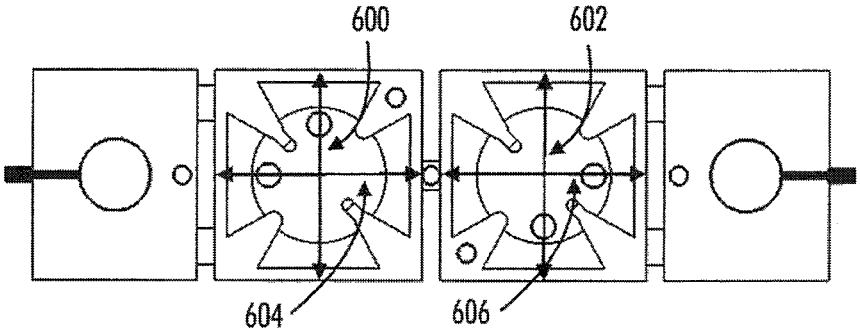
FIG. 6 illustrates electric field vector directions in dielectric loaded cavities.

FIG. 6 illustrates the E-field vector directions in the dielectric loaded cavities. TM01 δ(y) E-fields are designated with vectors 600, 602 and TM01 δ(x) E-fields are designated with vectors 604, 606.

The resonator 506 and TM 01 δ(x) have magnetic fields orthogonal each other so the typically used magnetic field coupling stays very low. However, in an embodiment, the wall 522 has irises or slots on both sides of the centre part of the wall. In addition, there may be a gap 710 on the top side of the wall. Thus, the height of the wall section between the irises is shorter than the wall sections between the irises and the end of the wall. Thus, it operates as a coupling element. The wall 522 has magnetic field coupling to the coaxial resonator 502 and electric field coupling to TM 01 δ(x). The coupling may be controlled by iris depths and widths and centre part width and the centre part gap to top level.

Figure 7A:
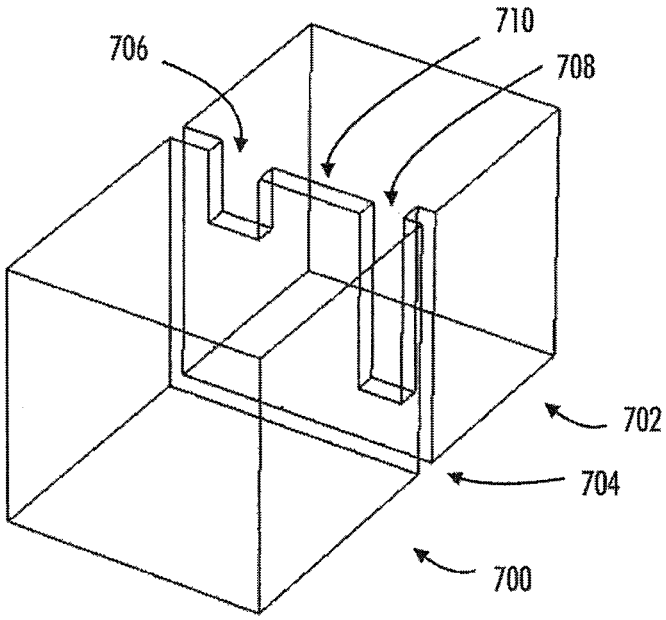
FIGS. 7A and 7B illustrate an example of the structure of a wall between cavities of a filter.
Figure 7B:
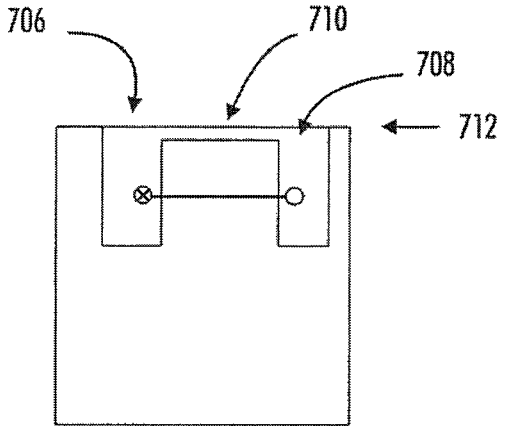

FIGS. 7A and 7B illustrate the proposed structure of the wall between cavities, the structure creating a coupling between single mode TM01 or coaxial resonator cavity 502 to TM01 δ(x+y) cavity. FIG. 7A shows two cavities 700, 702 and the wall 704 between the cavities. The wall has two irises or slots 706, 708, the irises being located in the upper edge of the wall, and the irises being on different sides of the centre of the wall. In an embodiment, the distance from the ends of the wall to the iris is different for each iris.

In an embodiment, the gap 710 on the top side of the wall may be 1 to 5 mm from the cavity top level 712. When the irises 706, 708 have the same depth the coupling to TM01 δ(y) mode is weak and main coupling is to TM01 δ(x). The so called cross coupling is minor. When the iris depths are increased the coupling increases. The centre part can be in the middle of the wall or on either side increasing the cross coupling effect and minimizing the parasitic couplings which tends to exist in multimode design because of small distance between resonance elements.

Returning to FIG. 5, fine tuning of coupling may be done by tuning screw 524. High coupling such as over 70 MHz at 1800 MHz band can be created by a wall part shape that has self-resonance near pass band about 20% above pass band frequency. If resonance of the wall is increased the coupling decreases.

It possible to create a coupling from the coaxial cavity 502 to TM 01 δ(y) mode, rod 512, by a wall shape in which iris or slot depths are not same, as I the case in FIG. 7A. This is called a cross coupling and it enables a topology that creates notches below or above pass band in pass band filters.

When the wall irises have different depths the magnetic field in wall rotates to direction of TM 01 δ(y) and a coupling effect is created. When irises of the wall have the same depth a cross coupling effect is small (<10%) compared to main coupling between the coaxial resonator 502 and TM 01 δ(x) modes.

The coupling between TM modes in the dielectric loaded cavity can be created by asymmetric dielectric body or using conductive part like screw(s) 116 at cavity edges or asymmetric cavity shapes.

TM 01 δ(x) resonance frequency can be tuned by the screw 1148 and TM 01 δ(y) by the screw 114A.

Figure 8:
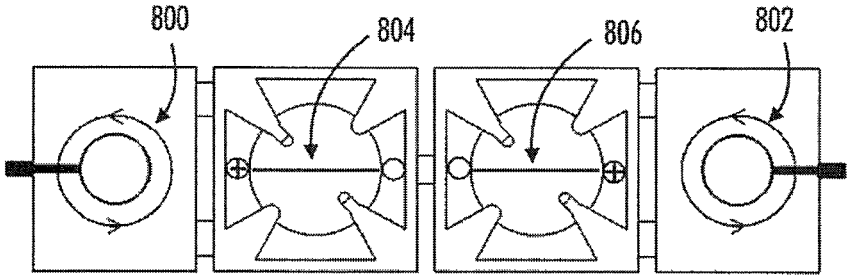
FIG. 8 illustrates magnetic field vector directions in dielectric loaded cavities.

The coupling between TM 01 δ(y) modes between second cavity 506 and third cavity 508 may be created by a narrow iris and tuning screw 526 in the wall 528 at centre of the filter. This is a traditional magnetic field coupling. These H-field vectors are illustrated in FIG. 8. TM01 δ(y) magnetic fields (H-fields) are designated with vectors 800, 802 and TM01 δ(x) electric fields (E-fields) with vectors 804, 806.

The coupling topology and structure between the third cavity 508 and fourth cavity 504 continue towards output 530 as between the first cavity 502 and the second cavity 506.

Figure 9:
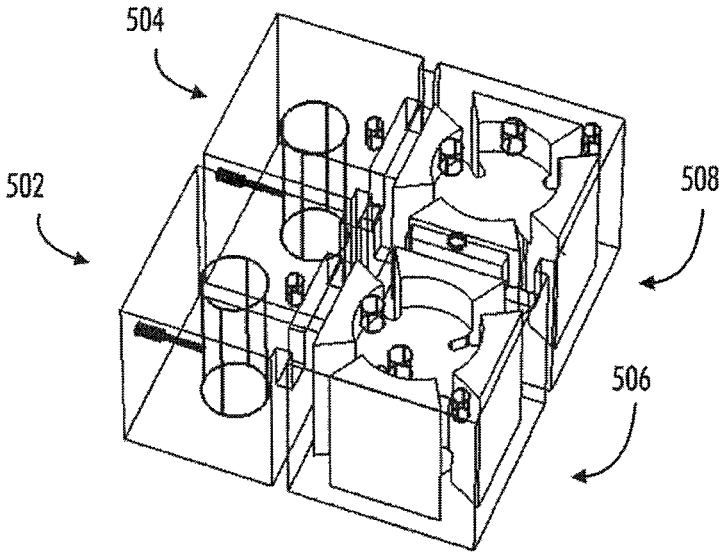
FIG. 9 illustrates another example of a radio-frequency filter.

FIG. 9 illustrates another example of a radio-frequency filter where above described resonator structure is utilised. Like in the example of FIG. 5, the example filter of FIG. 9 is an eight pole microwave band pass filter consisting of two coaxial resonator cavities 502, 504 and two dual mode dielectric resonators 506, 508. The same dielectric body shapes and coupling solutions may be used as in the example of FIG. 5. The U-shape of the filter does not have an effect on the couplings.

It will be obvious to a person skilled in the art that, as the technology advances, the inventive concept can be implemented in various ways. The invention and its embodiments are not limited to the examples described above but may vary within the scope of the claims.

The invention claimed is:

1. A radio-frequency filter having at least one dielectric multi-mode resonator, the resonator comprising:

a metal housing with a top surface, a bottom surface, four sides between the top and bottom surfaces, and creating a resonator cavity therein;

a dielectric body positioned inside the cavity, the dielectric body having a first thickness between the top and bottom surfaces of the cavity, there being a gap between the sides of the housing and the dielectric body;

the dielectric body having a first hollow on a first surface facing the top surface of the housing and a second hollow on the second surface facing the bottom surface of the housing, the dielectric body thereby having a second thickness at the location of the first and second hollows, the second thickness being smaller than the first thickness, and the dielectric body further having an outer surface facing the four sides of the metal housing, said outer surface being divided into sectors facing said four sides, wherein the dielectric body has four cuts dividing the sectors facing the four sides into four sections.

2. The radio-frequency filter according to claim 1, wherein the size of the gap is between 2 and 10% of the width of the metal housing.

3. The radio-frequency filter according to claim 1, wherein each of the four sections has a variable width in the direction perpendicular to the top and bottom surfaces of the resonator cavity, wherein the variable width is largest at the side of the section facing the housing.

4. The radio-frequency filter according to claim 3, wherein the first and second hollows extend partly into the four sections of the dielectric body.

5. The radio-frequency filter according to claim 1, the resonator further comprising one or more screws in the cuts of the dielectric body.

6. The radio-frequency filter according to claim 1, wherein the resonant cavity and the dielectric body each have a cuboid shape.

7. The radio-frequency filter according to claim 1, wherein the second thickness is 20 to 50% smaller than the first thickness.

8. The radio-frequency filter according to claim 1, wherein the dielectric body has on the side facing the top surface of the housing one or more holes for the insertion of one or more screws.

9. The radio-frequency filter according to claim 1, wherein the dielectric body has a hole in the centre of the side facing the top surface of the housing, the hole extending through the dielectric body.

10. The radio-frequency filter according to claim 9, wherein the hole in the centre is at least partially plated with metal.

11. The radio-frequency filter according to claim 1, wherein the first and second hollows on the top and the bottom of the dielectric body are of equal size and form.

12. The radio-frequency filter according to claim 1, further comprising at least two coaxial resonators, the at least one dielectric multi-mode resonator being connected between two coaxial resonators, each resonator being separated from a neighbouring resonator by a wall, wherein a coupling between a coaxial resonator and the at least one dielectric multi-mode resonator is realised with two irises in the wall, the irises being located in the upper edge of the wall, the two irises being on different sides from the centre of the wall.

13. The radio-frequency filter according to claim 12, wherein the distance from the ends of the wall to the iris is different for each iris.

14. The radio-frequency filter according to claim 12, wherein the height of the wall section between the irises is shorter than the wall section between the irises and the end of the wall.

* * * * *